US005109909A

United States Patent [19]

Hong

[11] Patent Number: 5,109,909

[45] Date of Patent: May 5, 1992

[54] VENETIAN BLIND

[76] Inventor: Amy Hong, No. 9, Jenn-Shing Lane, Fu-Nan Village, Fu-Shing Hsiang, Changhua Shiann, Taiwan

[21] Appl. No.: 699,026

[22] Filed: May 13, 1991

[51] Int. Cl.[5] ..... E06B 9/30

[52] U.S. Cl. ..... 160/168.1; 160/178.1

[58] Field of Search ..... 160/168.1, 176.1, 178.1, 160/173, 177, 178.1, 166.1, 172

[56] References Cited

U.S. PATENT DOCUMENTS

| | | | |
|---|---|---|---|
| 3,727,665 | 4/1973 | Debs | 160/168.1 X |
| 4,327,797 | 5/1982 | Nakajima et al. | 160/168.1 |
| 4,487,243 | 12/1984 | Debs | 160/168.1 |
| 4,637,445 | 1/1987 | Nilsson | 160/168.1 X |
| 4,772,383 | 2/1988 | Kross | 160/168.1 X |
| 4,886,102 | 12/1989 | Debs | 160/168.1 X |

*Primary Examiner*—David M. Purol
*Attorney, Agent, or Firm*—Browdy and Neimark

[57] ABSTRACT

An improved Venetian blind comprises a top rail, a bottom rail, a predetermined number of ladder tapes fastened to top and bottom rails at both ends thereof, a predetermined number of slats held on to ladder tapes, a draw cord pulley lock set, a draw cord set, an adjusting member with a connection head attached thereto for use in controlling the ladder tapes to tilt the slats, a tilt rod, and four end caps disposed at both ends of top and bottom rails. The improved blind is characterized in that the top rail includes a receiving portion serving to accommodate the draw cord pulley lock set and a connection head and that the end caps are of an insertion type so as to prevent the slats from being pressed against by the pulley lock set, the connection head, and the end caps when the blind is drawn up completely.

3 Claims, 3 Drawing Sheets

VENETIAN BLIND

BACKGROUND OF THE INVENTION

The present invention relates to a Venetian blind, and more particularly to an improved Venetian blind whose slats are not vulnerable to deformation in the course of transportation thereof.

As shown in FIGS. 1 and 2, a conventional Venetian blind 10 of prior art comprises mainly a top rail 11, a bottom rail 12, two ladder tapes 13, a predetermined number of slats 14, a draw cord set 15, and a tilt rod 17.

The two ladder tapes 13 are arranged in parallel to each other and are fastened securely to top and bottom rails 11 and 12 at both ends thereof. Located between top and bottom rails 11 and 12 are a predetermined number of slats 14, which are arranged horizontally in parallel to one another and are held on to two ladder tapes 13. The draw cord set 15 is arranged in such ways that it is fastened securely to the bottom rail 12 at one end thereof and that its other end pierces through slats 14 and top rail 11 to reemerge via a pulley lock set 16. The upward and the downward movements of bottom rail 12 is controlled by the draw cord 15 by means of a pulley lock set 16. The tilt rod 17, which is fastened to the top rail 11 on the side opposite to the draw cord 15, is used to control the adjusting member (not shown in drawings) which in turn regulates the up-and-down motion of two ladder tapes 13 so as to tilt the slats 14 to an angle permitting the sunlight to enter the room in a desired direction.

The conventional Venetian blind 10 of prior art looks like what is shown in FIG. 1 when drawn completely. The slats 14 are subject to pressure so as to bend due to the pulley lock set 16 which extends into the inside of the top rail 11. In addition, the connection head 18 of the adjusting member and the end caps 19 of top and bottom rails 11 and 12 can also cause the slats 14 to bend, as shown in FIGS. 1 and 2. The slats 14 are generally made of plastic material and are therefore vulnerable to deformation under stress and high temperature in the course of shipment thereof.

SUMMARY OF THE INVENTION

It is, therefore, the primary objective of the present invention to provide a Venetian blind with an improved structure, which is characterized in that it includes a receiving portion extending from the front surface of the top rail, with a predetermined distance from the edge of the slat. The receiving portion is used to accommodate the draw cord pulley lock set and the connection head so that they do not press against the slats when the blind is drawn up.

It is another objective of the present invention to provide a Venetian blind with top and bottom rails having end caps of insertion type without the risk of slats being pressed against when the blind is drawn up.

In keeping with principles of the present invention, the primary objectives of the present invention are accomplished by an improved Venetian blind, which comprises a top rail, a bottom rail, a predetermined number of ladder tapes fastened to top and bottom rails at both ends thereof, a predetermined number of slats held on to ladder tapes, a draw cord pulley lock set, a draw cord set, an adjusting member with a connection head attached thereto for use in controlling the ladder tapes to tilt the slats, a tilt rod, and four end caps disposed at both ends of top and bottom rails. The improved blind is characterized in that the top rail includes a receiving portion serving to accommodate the draw cord pulley lock set and a connection head and that the end caps are of an insertion type so as to prevent the slats from being pressed against by the pulley lock set, the connection head, and the end caps when the blind is drawn up completely.

DETAILED DESCRIPTION OF THE PREFERRED EMBODIMENT

Figure 1:
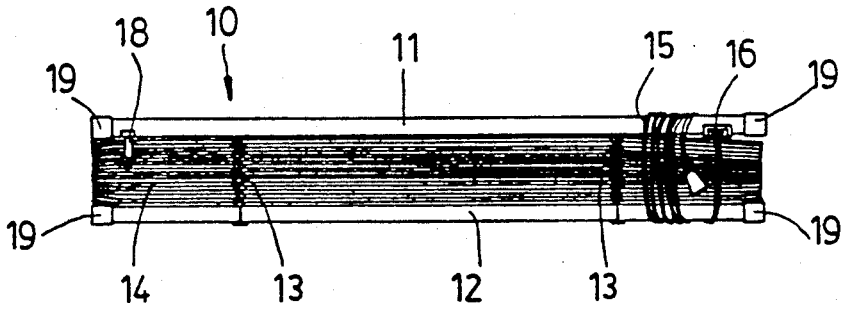
FIG. 1 PRIOR ART
FIG. 1 shows a front view of a prior art Venetian blind which is drawn up completely.
Figure 2:
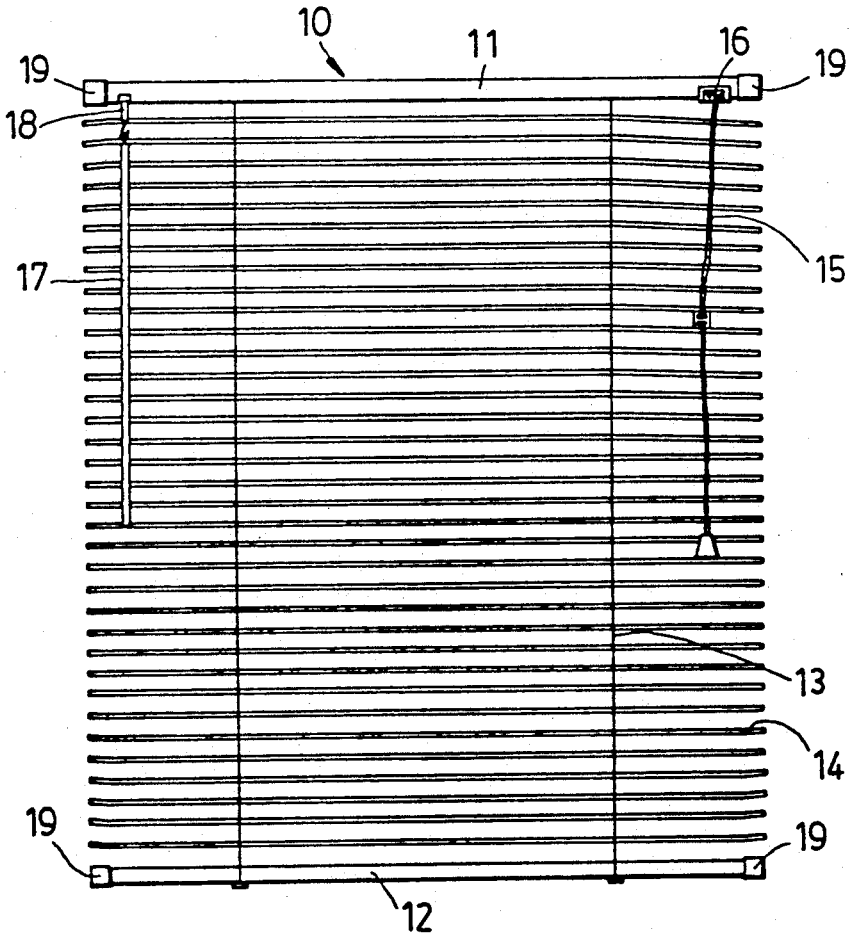
FIG. 2 PRIOR ART
FIG. 2 shows a front view of a prior art Venetian blind which has been pulled down completely.

Referring to FIGS. 1–6, the Venetian blind 20 embodied in the present invention is shown comprising a top rail 21, a bottom rail 22, two ladder tapes 23, a predetermined number of slats 24, a draw cord set 25, a draw cord pulley lock set 26, a tilt rod 27, a connection head 28, and four end caps 29.

Figure 4:
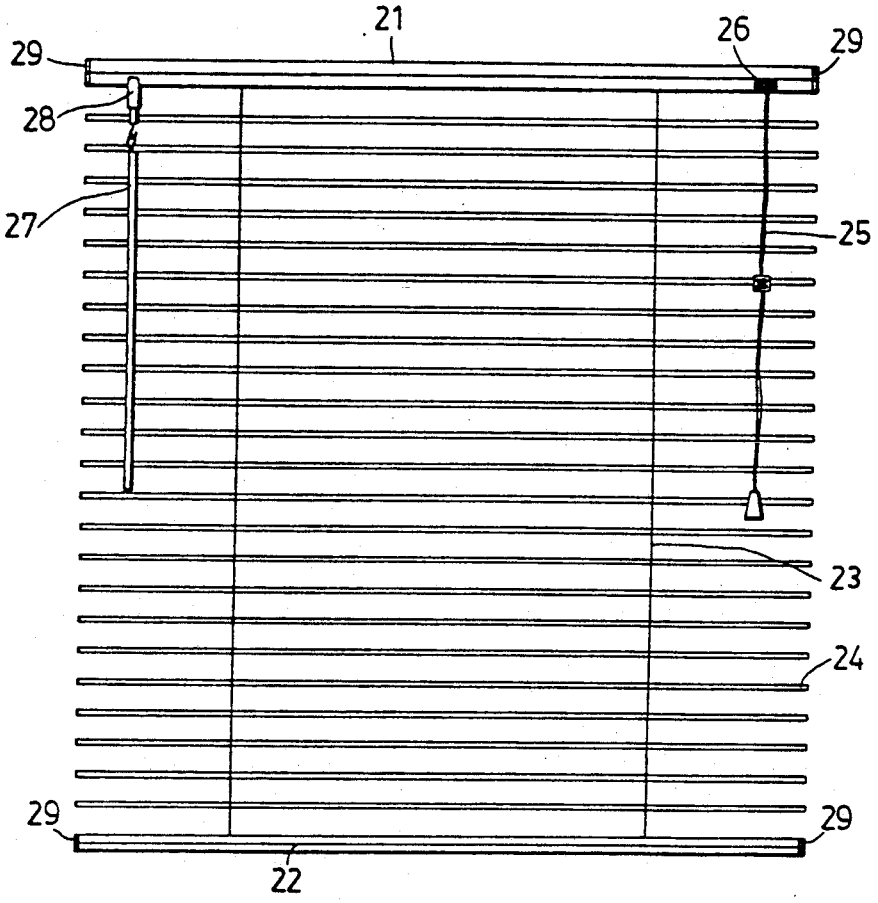
FIG. 4 shows a front view of FIG. 3.
Figure 5:
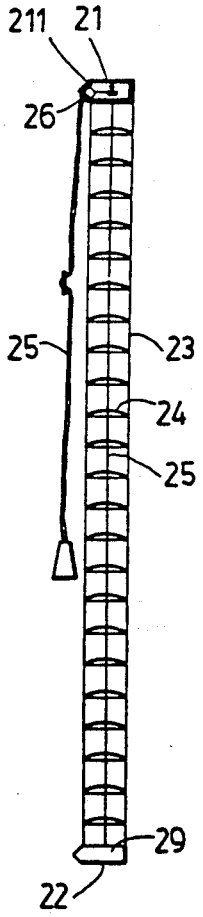
FIG. 5 shows a side view of FIG. 3.
Figure 6:
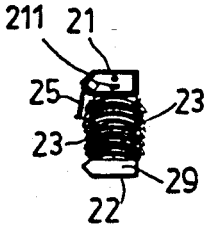
FIG. 6 shows a drawn-up view of FIG. 5.
Figure 3:
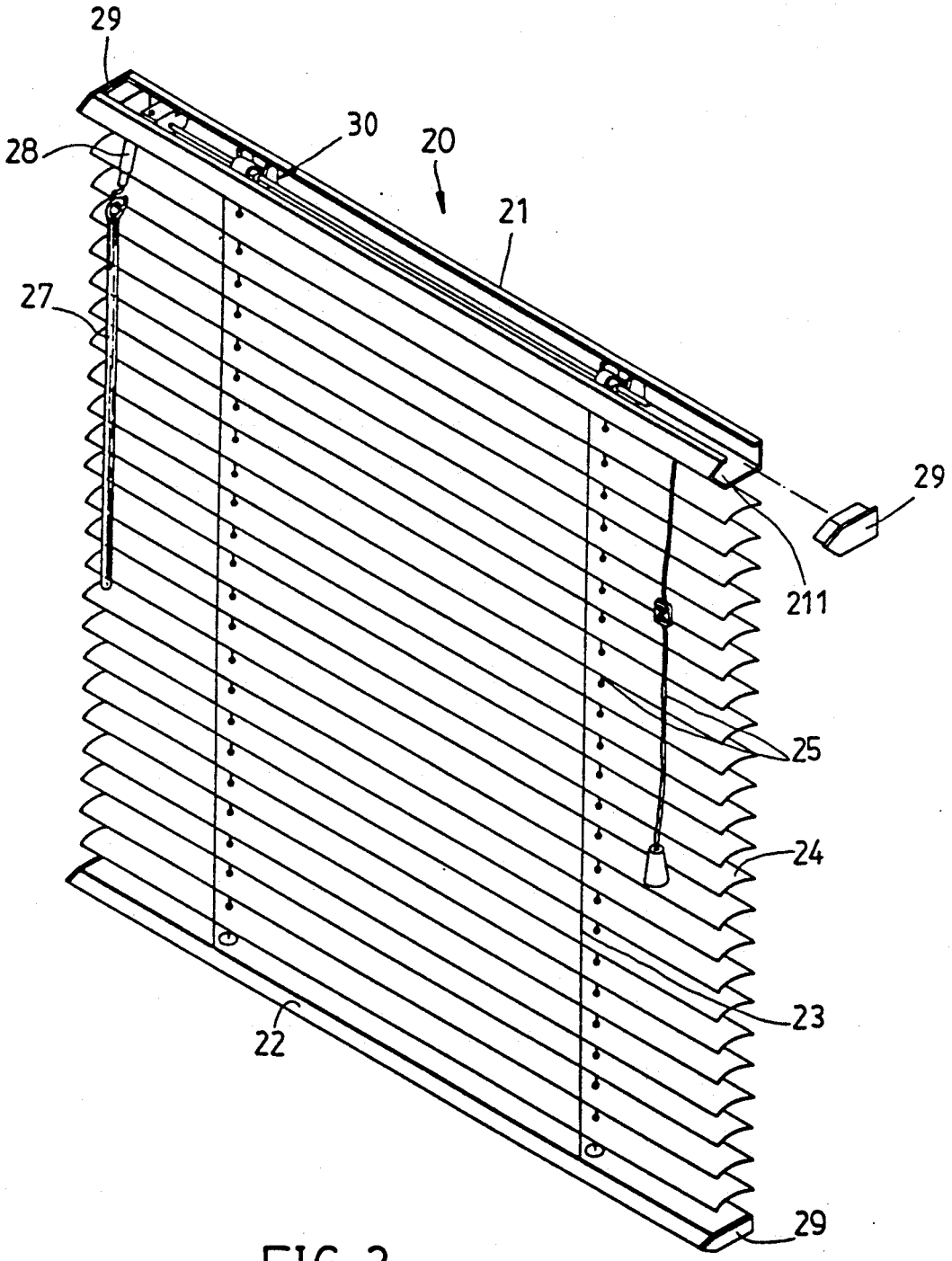
FIG. 3 shows an external three-dimensional view of the preferred embodiment of the present invention.

The top rail 21 includes a triangular receiving portion 211 extending from the front side thereof, with a predetermined distance from the edge of slat. The receiving portion 211 is used to accommodate the draw cord pulley lock set 26 and the connection head 28 of the adjusting member 30 as shown in FIGS. 3, 4, and 5. In addition, the end caps 29 of top rail and bottom rail 22 are of an insertion type. As a result, when the Venetian blind 20 of the present invention is drawn completely, the slats 24 will not be pressed against by the draw cord pulley lock set 26, the connection head 28, and the end caps 29, thereby minimizing the risk of deformation of slats in the course of shipment thereof.

What I claim is:

1. An improved venetian blind comprising a top rail, a bottom rail, a predetermined number of ladder tapes fastened to said top rail and said bottom rail at both ends thereof, a predetermined number of slats held on to said ladder tapes, a draw cord pulley lock set, a draw cord set, an adjusting member with a connection head attached thereto, a tilt rod, and four end caps, said top rail and said bottom rail each respectively formed as a tube having a top, bottom, rear and front side and open ends, said front side of said top rail and said bottom rail respectively having an upper face and a lower face integrally connected at an angle, a width of said predetermined number of slats substantially equal to a width of said bottom side of said top rail and said top side of said bottom rail, said draw cord pulley lock set and said connection head mounted on said lowerface of said front side of said top rail with the respective axis of said draw cord pulley lock set and said connection head located at an angle to said lower face, wherein, when said venetian blind is drawn closed said draw cord pulley lock set and said connection head are positively spaced away from said slats.

2. The improved venetian blind in accordance with claim 1, wherein said angle between said upperface and said lower face of said front side of said top rail is at least 90°.

3. The improved venetian blind in accordance with claim 1, wherein the outer cross section of said top rail and said bottom rail is identical to an outer face of said four end caps, said four end caps respectively having means on an innerface for insertion in said open ends of said top rail and said bottom rail, wherein, when said four end caps are inserted in said open ends and said venetian blind is drawn closed, said four end caps are positively spaced away from said slats.

* * * * *